US007942613B2

(12) United States Patent
Lemaire

(10) Patent No.: US 7,942,613 B2
(45) Date of Patent: May 17, 2011

(54) PISTOL FOR INJECTING A SEALING PRODUCT FORMED BY MIXING AT LEAST TWO SOLUTIONS

(76) Inventor: Charline Lemaire, Cysoing (FR)

( * ) Notice: Subject to any disclaimer, the term of this patent is extended or adjusted under 35 U.S.C. 154(b) by 513 days.

(21) Appl. No.: 11/921,087

(22) PCT Filed: May 30, 2006

(86) PCT No.: PCT/FR2006/001224
§ 371 (c)(1),
(2), (4) Date: Jan. 17, 2008

(87) PCT Pub. No.: WO2006/129008
PCT Pub. Date: Dec. 7, 2006

(65) Prior Publication Data

US 2009/0266009 A1 Oct. 29, 2009

(30) Foreign Application Priority Data

May 30, 2005 (FR) ..... 05 05440

(51) Int. Cl.
*E02D 5/18* (2006.01)
*B05B 7/02* (2006.01)
*B05B 7/12* (2006.01)

(52) U.S. Cl. ..... 405/269; 239/525; 239/527; 239/416.4; 239/416.5

(58) Field of Classification Search ..... 239/525, 239/527, 530, 531, 398, 416.4, 416.5, 423; 405/269, 233, 240, 223; 222/137
See application file for complete search history.

(56) References Cited

U.S. PATENT DOCUMENTS

| | | | | | |
|---|---|---|---|---|---|
| 2,960,831 | A | * | 11/1960 | Lonaberger et al. | 405/263 |
| 3,828,980 | A | | 8/1974 | Creighton et al. | |
| 4,260,295 | A | * | 4/1981 | Vestlund | 405/269 |
| 4,302,132 | A | * | 11/1981 | Ogawa et al. | 405/269 |
| 4,471,643 | A | * | 9/1984 | Champoux et al. | 72/370.07 |
| 4,992,004 | A | * | 2/1991 | Haug | 405/269 |
| 5,342,149 | A | * | 8/1994 | McCabe et al. | 405/269 |
| 6,663,021 | B1 | * | 12/2003 | Scarpa et al. | 239/424 |
| 2002/0170926 | A1 | | 11/2002 | Horner et al. | |

FOREIGN PATENT DOCUMENTS

| | | | |
|---|---|---|---|
| CH | 384 842 | A | 2/1965 |
| DE | 298 24 638 | U1 | 3/2002 |
| FR | 2 721 840 | A1 | 1/1996 |
| WO | WO 97/18367 | A | 5/1997 |

* cited by examiner

*Primary Examiner* — Dinh Q Nguyen
*Assistant Examiner* — Justin Jonaitis
(74) *Attorney, Agent, or Firm* — Kenyon & Kenyon LLP

(57) ABSTRACT

The pistol is used for injecting through a hole a sealing product formed by a mixture of at least two solutions. It comprises a tubular injection system which is fed, notably under pressure, with each of said solutions, and which ends with an injection head capable of penetrating into the injection hole. The tubular system includes for each solution, an independent transfer conduit emerging from the end of the injection head, so that the mixing of the solutions is performed outside the injection head. Preferably, the first transfer conduit is a tube with a circular cross-section and the other transfer conduit(s) has(have) an annular cross-section, being delimited by one or several tubes arranged concentrically around the first transfer conduit.

6 Claims, 3 Drawing Sheets

PISTOL FOR INJECTING A SEALING PRODUCT FORMED BY MIXING AT LEAST TWO SOLUTIONS

This is a 371 national phase application of PCT/FR2006/001224 filed 30 May 2006, claiming priority to French Patent Application No. FR 0505440 filed 30 May 2005, the contents of which are incorporated herein by reference.

FIELD OF THE INVENTION

The present invention relates to a pistol for controlled injection of sealing products into local areas of structures having defects in water tightness, or in media to be stabilized. The injected product is generally a mixture of several chemical constituents in relative volumes which may be different. This mixture is injected by means of a pistol and a bicomponent pump, depending on the field of use, into non-watertight expansion joints, in cracks of concrete structures, such as tunnels, underground galleries, dams, cofferdams.

BACKGROUND OF THE INVENTION

Concrete structures, subject to water pressure or buried, often include defects in tightness such as cracks, teeming arrests, non-waterproof expansion joints, coating defects of metal building components, porosities, honeycombing, at which water tightness is not ensured and where water leaks occur.

In order to ensure water tightness of these local defective areas, particularly when the liquid leaks are subject to pressure and/or have a high flow rate, it is not possible to use cement or concrete for sealing the leaking areas. The bulk concrete or cement setting time is too long to allow such leaks to be sealed.

In the case when despite everything a sealing-off of the leaks would be obtained with these materials, this seal would be rigid and would rapidly break subsequently to ground movements, expansions or contractions due to temperature differences.

It is known how to use two chemicals mixed before injection into the concrete by means of injectors, either screwed into the concrete at right angles to the defect, or of the expansive type.

These injectors have the following significant defects:

These injectors after drilling the concrete must be screwed into the support, and require the use of tools, their length and diameter should be different depending on the thickness of the concrete and on the nature of the problem to be solved.

If the injector is too short or positioned too close to the surface of the concrete, there is a high risk that the support is pulled off and/or burst upon applying pressure.

After drilling in the horizontal or vertical planes, it is required that the drilling dust be removed by blowing or washing, otherwise the injector will not be able to fulfil its role, the cracks or joints being filled with drilling dust.

After injection, the injectors are most often stuck by the injection product and cannot be recovered, they are then left in place or cut to be level with the surface of the support where they will oxidize, thereby causing oxidization spots which are difficult to suppress.

Quasi-routine replacement of these injectors has a significant effect on the financial supply and labor position.

The injector which has remained in place, blocked by the injection product, cannot be re-injected; a new perforation is required.

If the injectors have to be removed from the support with a tool of the "hub extractor" type, the operation is likely to cause damages at the surface of the support: the latter will have to be repaired.

The pistol connected to the injector should be connected and disconnected at each injection, which promotes flows of resin onto the surroundings, the tooling, the operator.

The injector-pistol assemblies on the market allow the contact of different components of the injected resin and require constant cleaning and attention, the chemicals being polymerized in the injector-pistol assemblies.

The injectors on the market have to be connected to an injection pistol, a mandatory relay towards the pump, thereby complicating the injection procedure, the maintenance, the reliability with an increase of costs.

SUMMARY OF THE INVENTION

The object of the present invention is to propose an injection pistol which overcomes all or part of the aforementioned drawbacks.

This is a pistol for injecting through an injection hole, a sealing product formed by a mixture of at least two solutions, said injection pistol comprising in a way known from document FR.2.553.304, a tubular injection system which is fed, notably under pressure, with each of said solutions and which ends with an injection head capable of penetrating into the injection hole.

In a characteristic way, according to the present invention, the tubular system includes for each solution, an independent transfer conduit emerging from the end of the injection head, so that the mixing of the solutions is performed outside the injection head.

According to this particular arrangement, the mixing of the chemical solutions with which the sealing product may be formed, is performed not in the injection device but at the outlet of the latter, in the seal defect to be sealed. So there is no longer any risk of fouling the injection head with the polymerized sealing product.

According to an alternative embodiment, a first conduit for transferring a given solution is a tube with a circular cross-section and at least one other conduit for transferring at least another solution with an annular cross-section, which is delimited by at least a tube arranged concentrically around the first transfer conduit. Thus, at the outlet of the injection head, the solution conveyed by the first transfer conduit is necessarily in contact with the solution conveyed by the transfer conduit which surrounds it in an annular way.

According to an alternative embodiment, the injection head includes towards its end, a sleeve which is crossed by the transfer conduits and which is expansible, by expansion means, between a rest position in which the injection head may be introduced into the injection hole and an expanded position in which the sleeve is sealably applied onto the walls of the injection hole. With this arrangement, the sealing product cannot flow back towards the outside in the injection hole but remains necessarily localized in the defect to be sealed.

According to an embodiment of this alternative, the expansible sleeve is a flexible tube with elastic radial deformation. Further, the expansion means include a part with a frusto-conical shape which is crossed by the transfer conduits. Finally the frusto-conical part and the expansible sleeve may be displaced relative to each other between a rest position in which the small base of the frusto-conical part is in proximity to an aperture of the sleeve and an active position in which the frusto-conical part has forcibly penetrated from said small base into said aperture, which causes the increase of the outer diameter of the sleeve.

It is understood that the injection head should be able to penetrate into the inside of the injection hole until the expansible sleeve is placed at the walls of said injection hole. Thus, in its rest position, the sleeve should have an outer diameter less than the inner diameter of the injection hole. With the radial deformation of the flexible tube forming the expansible sleeve, the latter may press against the walls of the injection hole until it forms a seal gasket preventing the mixture of the solutions during polymerization from flowing back towards the outside around the injection head.

In one embodiment, the tubular system comprises a protective tube containing the transfer conduits and at the end of which the expansible sleeve is attached, notably via a receiving ring. The protective tube forms a somewhat protective sheath for the transfer conduits. It also provides attachment of the expansible sleeve. With the presence of the receiving ring, it is possible to form a rigid attachment point for the sleeve during its expansion.

According to one embodiment, the injection pistol of the present invention comprises a dual action actuator, the actuation of which controls the dual relative displacement of the frusto-conical part and of the sleeve. Therefore, the operator after having introduced the injection head into the injection hole, may quite simply control the expansion of the sleeve by actuating the cylinder, and next, after injecting the mixture of the solutions, the passing of the sleeve into the rest position so as to be able to remove the injection head from the injection hole.

According to one embodiment, the body of the dual action actuator is connected to the frusto-conical part via the transfer conduits.

According to an alternative embodiment of the present invention, the injection pistol includes a compressed air supply. In the case when the dual action actuator is of the pneumatic type, this compressed air supply may be connected onto the cylinder of the actuator.

Further, provision may be made for sending the compressed air into the space between the protective tube and the transfer conduits right up to the end of the injection head. The operator by actuating the compressed air supply, may therefore achieve by blowing, removal of the dusts from the bore of the injection hole. He/she may also at the end of the operation and after removing the injection head from the hole, remove by blowing, the sealing product which might be found on the surface of the frusto-conical part.

In a preferred embodiment, the injection pistol of the present invention includes two subassemblies jointed with each other, i.e.:

a) a first subassembly comprising the ducts for introducing the solutions, the transfer conduits, the frusto-conical part and the dual action actuator body and b) a second subassembly comprising a carrying handle, the protective tube, the sleeve and the cylinder of the dual action actuator.

Both of these two subassemblies are connected together through a hinged connection allowing relative longitudinal displacement without any rotation of both subassemblies relative to each other upon actuating the actuator.

BRIEF DESCRIPTION OF THE DRAWINGS

The present invention will be better understood upon reading the description which will be made of a preferred exemplary embodiment of an enhanced injection pistol, illustrated by the appended drawing, wherein.

DETAILED DESCRIPTION

In the injection pistol 30 which will be described hereafter, the sealing product is made from a mixture of two chemical solutions. This is not exclusive of the present invention; the number of chemical solutions to be mixed may be larger than two.

In the present case, this may notably be a mixture of an aqueous acrylic solution and an aqueous solution containing a polymerization initiator, of the type of that described in document FR.2.630.743.

Figure 1:
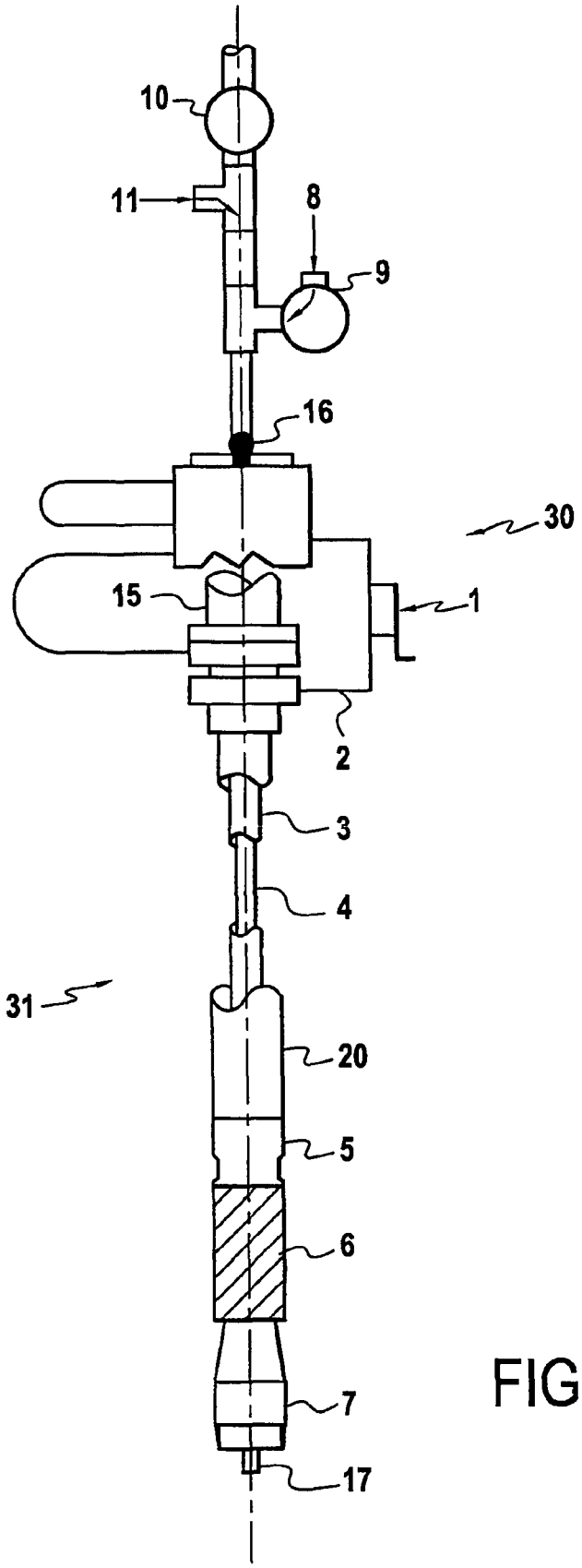
FIG. 1 is a very schematic illustration of the different components of the pistol.
Figure 2:
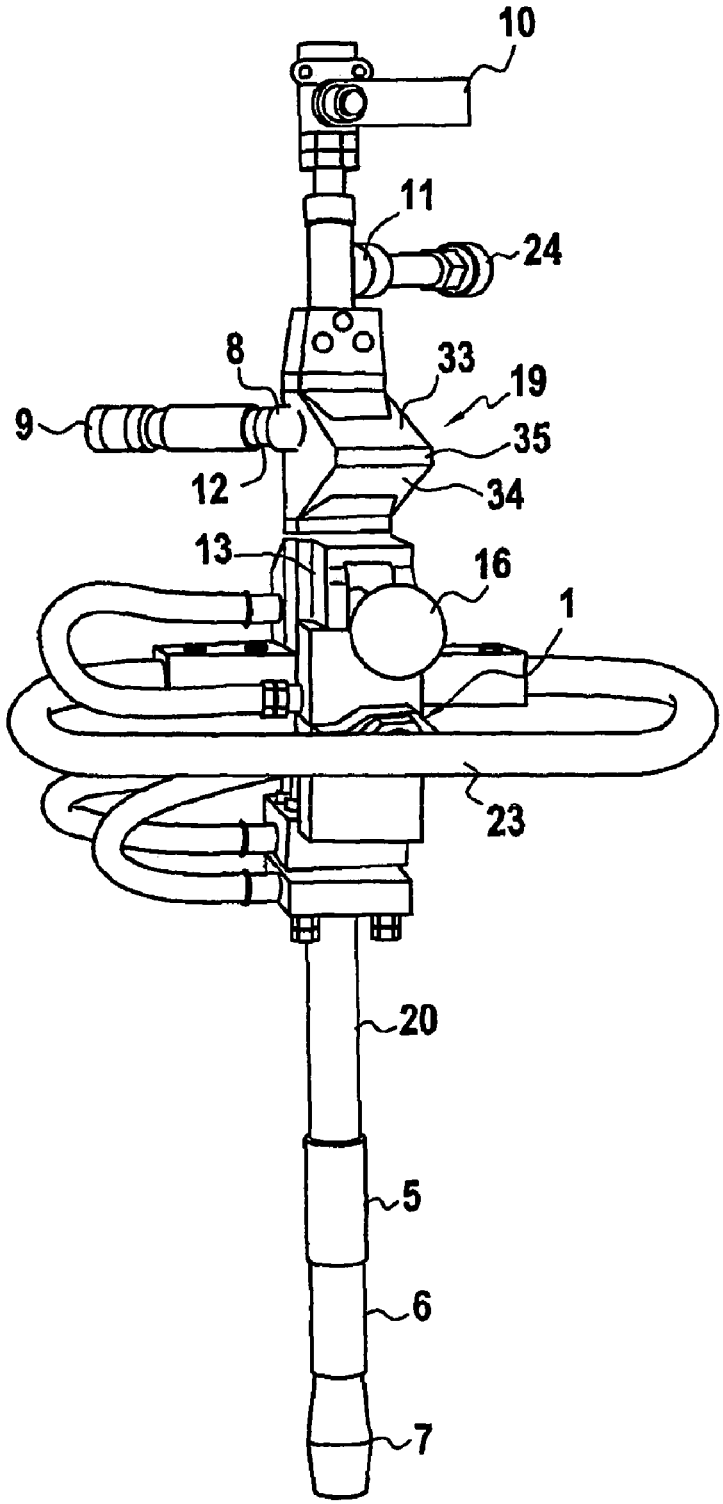
FIG. 2 is a side view of the pistol of FIG. 1.
Figure 3:
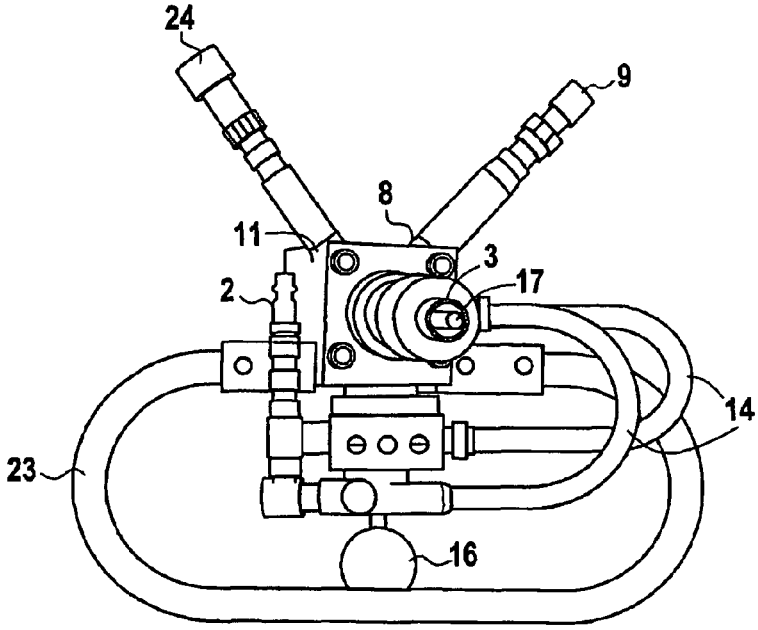
FIG. 3 is a bottom view of the pistol of FIG. 1 and FIGS. 4A and B illustrate the rest and expanded positions of the sleeve fitting of the injection head of the pistol of FIG. 1.

With reference to FIG. 1, the injection pistol 30 includes an injection head 31 which is fed with each of both chemical solutions from a first intake 8 for the solution corresponding to the resin and from a second intake 11 as for the solution containing the polymerization initiator. At least the first intake 8 is fitted out with a non-return valve and a fast coupler 9. Each of these intakes opens into the transfer conduit which is specific to it. In FIG. 1, at the injection head 31, transfer conduits 3, 4 may be seen, which are positioned concentrically along the longitudinal axis of the injection head. The transfer conduit 4 is a tube with a circular section. It is intended to convey the solution containing the polymerization initiator, supplied from the intake 11. The transfer conduit for the resin, from the intake 8, is an annular transfer conduit, internally delimited by the first tube 4 and externally delimited by the second tube 3.

The pistol 30 includes a dual action actuator 15 which may be pneumatic, electric, electro-mechanical or hydraulic. Its connection 2 is adapted to its operating mode. In the present case, this may be a compressed air supply 1.

Both tubes 3, 4, notably made in stainless steel 316L, are contained in a protective tube 20 which may also be in stainless steel 316L or in aluminum. Both tubes 3, 4, are firmly attached to the actuator 15 and at their other end, to a frusto-conical part 7, through which the tubes 3, 4 pass. In FIG. 1, the end 17 of the first tube 4 feeding the solution containing the polymerization initiator opens out beyond the second tube 3.

At the distal end of the protective tube 20, a receiving ring 5 is provided allowing an expansible sleeve 6 to be attached thereto. In the present case, this is a flexible tube which may be elastically deformed radially.

The proximal end of the protective tube 20 is firmly attached to the cylinder of the dual action actuator 15.

Overall the injection pistol 30 consists of two subassemblies which are jointed with each other by a hinged connection 19 so as to allow the expansible sleeve 6 and of the frusto-conical part 7 to be relatively displaced with respect to each other.

The first subassembly comprises the ducts for introducing the solutions, the transfer conduits, i.e. both tubes 3, 4, the frusto-conical part 7 and the body of the dual action actuator. The second subassembly comprises the protective tube 20, the sleeve 6 and the cylinder of the dual action actuator. This second subassembly also comprises a structural component on which a carrying handle 23 is attached.

Figure 4A:
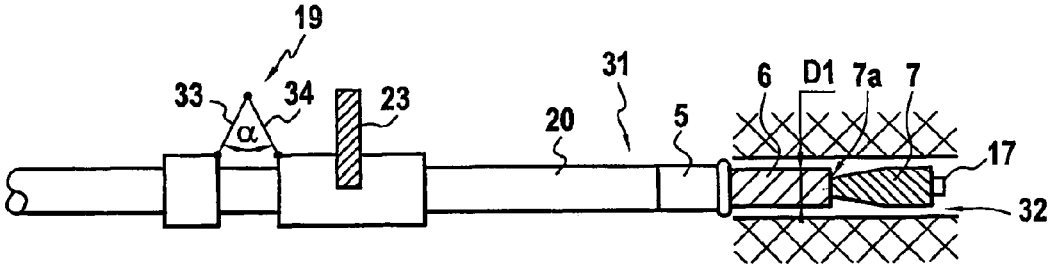
Figure 4B:
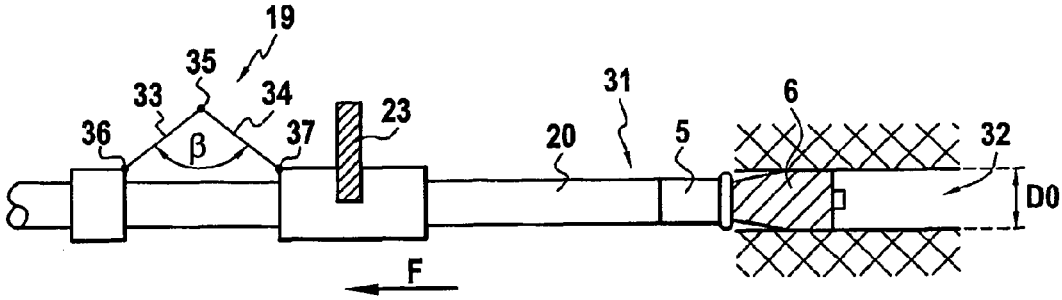

Both positions are illustrated schematically in FIG. 4, the rest position on the one hand (FIG. 4A) and the expanded position on the other hand (FIG. 4B).

First of all, the operator has proceeded with drilling an injection hole 32 of a determined diameter D0. He/she positions the injection head 31 so as to cause the frusto-conical part 7 to penetrate into the injection hole and the expansible sleeve 6 in the rest position, having in this condition an outer diameter D1, which substantially corresponds to the outer diameter of the protective tube 20. He/she then actuates from the handle 16, the dual effect actuator 15, so as to displace the cylinder relatively to the body of the actuator in the direction of the arrow F (FIG. 4B). This backward displacement relatively to the carrying handle 23 will correlatively cause backward motion of the frusto-conical part 7 inside the injection hole 32. During this displacement, the small base 7*a* of the frusto-conical part 7 which was in proximity to the distal aperture of the sleeve 6 penetrates into the inside of said aperture. At the end of the displacement, in the example illustrated in FIG. 4B, the frusto-conical part 7 has totally penetrated inside the sleeve 6, which is therefore deformed radially, consequently increasing the diameter D1. This radial deformation is provided so that the sleeve in the expanded position will be strongly applied against the inner walls of the injection hole 32, forming a sealed barrier.

It is in this spread position of the sleeve 6 that the operator may accordingly control the arrival of two chemical solutions which both emerge through transfer conduits right up to the end of the injection head, directly into the injection hole 32 and into the cavity to be sealed, without any possible backward flow around the injection head 31.

Actuation of the dual effect actuator 15 causes, as described above, the backward motion, relatively to the handle 23 of the first subassembly. In order to allow this backward motion, the injection pistol 30 is fitted out with a joint hinge 19, which is able to connect both subassemblies and withstand by angular pivoting the relative displacement of both of these subassemblies.

This hinge 19 consists of two plates 33, 34, connected to each other by a transverse pivot axis 35. Each plate 33, 34 is itself connected to a subassembly by a transverse pivot axis 36, 37. In the rest position of the injection pistol (FIG. 4A), both plates 33, 34 together form an angle $\alpha$. At the end of the backward motion, the sleeve 6 being in the expanded position (FIG. 4B), both plates 33, 34 together form an angle $\beta$ larger than the angle $\alpha$.

With this hinge mounted on three parallel transverse axes 35, 36, 37, both subassemblies may be displaced without any rotation.

When the sealing operation is finished, it is sufficient for the operator to actuate the handle 16 so as to perform the displacement of both subassemblies in the opposite direction, in order to put the sleeve 6 back into its rest position and to perform extraction of the injection head from the hole 32.

It is then sufficient for the operator to fill the portion of the hole 32 occupied by the sleeve 6 with a mortar without any shrinkage. Thus, it will subsequently be possible to reuse the same injection hole if necessary.

Notably in the case when the injection pistol includes a compressed air supply, for actuating the air actuator, this compressed air supply may also be used for removing the dusts caused by the drilling of the injection hole on the one hand and for cleaning the frusto-conical part 7 from possible deposits of sealing product which might have occurred, on the other hand. In this case, the compressed air supply is directed into the space between the protective tube 20 and the second tube 3 right up to the end of the injection head 31. This compressed air emerges through the injection head at the distal end of the sleeve and directly arrives on the outer surface of the frusto-conical part 7.

This frusto-conical part 7 may be in stainless steel or in a synthetic material. The flexible tube acting as a sleeve may also be in a synthetic material but which is flexible and sufficiently deformable so as to lead to the result as described earlier.

The intakes 8, 11 for the chemical solutions are connected to a pump connected to a hydraulic unit on the one hand and to the containers containing said solutions on the other hand. It is this pump which provides the chemical solution supply. It is connected to the injection pistol 30 at the beginning of the operation and disconnected at the end of the operation. Therefore, there is no loss of product or tedious cleaning. Connection and disconnection are achieved in a very simple and fast way.

Provision may also be made for a discharge handle 10.

The invention claimed is:

1. An injection pistol for injecting a sealing product formed by a mixture of a first solution and a second solutions through an injection hole, comprising:

a tubular injection system which is supplied with said first and second solutions under pressure, wherein the tubular injection system comprises:

a first transfer conduit to convey the first solution, said first transfer conduit comprising a first tube having a proximal end, a distal end, and a circular cross-section;

a second tube having a proximal end, a distal end, and a circular cross-section, said second tube arranged concentrically around the first tube;

a second transfer conduit to convey the second solution, said second transfer conduit comprising an annular cross-section defined by an annular space between the first tube and the second tube;

a protective tube having a proximal end and a distal end, said protective tube surrounding the first tube and the second tube, said first tube and said second tube adapted to be displaced relative to the protective tube;

an expansible sleeve having elastic radial deformation, said expansible sleeve being attached to the distal end of the protective tube; and a frusto-conical part attached to the distal end of the second tube, the distal ends of the first tube and the second tube passing through the frusto-conical part; and a dual action actuator adapted to control the displacement of the first and second tubes relative to the protective tube between a first rest position in which the expansible sleeve and the frusto-conical part can be introduced into the injection hole, and an expanded position in which the frusto-conical part is retracted proximally to expand the expansible sleeve against an inner wall of the injection hole for delivery of the first and second solutions to the injection hole without any backflow;

wherein a compressed air supply delivers compressed air to a space formed between the protective tube and the second tube up to the frusto-conical part for cleaning the frusto-conical part.

2. The injection pistol according to claim 1, wherein said compressed air supply is connected to the dual action actuator.

3. The injection pistol according to claim 1, wherein the distal end of the first tube extends further distally than the distal end of the second tube.

4. The injection pistol according to claim 1, further comprising a handle connected to the protective tube.

5. The injection pistol according to claim 1, further comprising a first intake for receiving the first solution connected to the first transfer conduit.

6. The injection pistol according to claim 1, further comprising a second intake for receiving the second solution connected to the second transfer conduit.

* * * * *